US011746998B1

(12) United States Patent
Ernst et al.

(10) Patent No.: US 11,746,998 B1
(45) Date of Patent: Sep. 5, 2023

(54) LIGHT DEVICE AND SUPPORT DEVICE

(71) Applicant: Coast Cutlery Co., Portland, OR (US)

(72) Inventors: Todd Ernst, Portland, OR (US); Brian Sheehy, Los Angeles, CA (US); David Goldman, Portland, OR (US); Paul Wood, South Pasadena, CA (US)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 17/871,832

(22) Filed: Jul. 22, 2022

(51) Int. Cl.

| | |
|---|---|
| ***F21V 21/08*** | (2006.01) |
| ***F21L 4/04*** | (2006.01) |
| ***F21V 21/14*** | (2006.01) |
| ***F21V 21/088*** | (2006.01) |

(52) U.S. Cl.
CPC ..... *F21V 21/0816* (2013.01); *F21L 4/045* (2013.01); *F21V 21/0832* (2013.01); *F21V 21/0885* (2013.01); *F21V 21/145* (2013.01)

(58) Field of Classification Search
CPC ..... F21V 21/086; F21V 21/0885; F21V 21/0832; F21V 14/025; F21V 21/145; F21L 4/045
USPC ..... 362/103, 618, 190, 191, 197, 198
See application file for complete search history.

(56) References Cited

U.S. PATENT DOCUMENTS

| | | | | |
|---|---|---|---|---|
| 5,176,438 | A * | 1/1993 | Fisherman | B43L 3/001 362/198 |
| 5,424,926 | A * | 6/1995 | Myers | A45C 15/06 362/253 |
| 5,904,280 | A * | 5/1999 | Chan | A45F 5/00 224/267 |
| 7,467,875 | B1 * | 12/2008 | Rama | G02B 6/0008 362/198 |
| 7,500,759 | B2 * | 3/2009 | Lin | F21V 17/007 362/198 |
| 8,523,377 | B1 * | 9/2013 | York | F21V 21/08 362/570 |
| 2009/0219709 | A1 * | 9/2009 | Chen | A41D 19/0157 362/103 |

* cited by examiner

*Primary Examiner* — Laura K Tso
(74) *Attorney, Agent, or Firm* — Schwabe Williamson & Wyatt, P.C.

(57) ABSTRACT

Various embodiments herein provide a light device that is selectively attachable to another device. For example, in some embodiments, the light device may be selectively attachable to a glove wrap that may be worn on a hand of a user. The light device may include a housing and a light unit coupled to the housing. The light unit may be selectively extendable from the housing, e.g., via a flexible neck. The light device may include an engagement mechanism to selectively attach the light device to the other device in any of multiple configurations. Other embodiments may be described and claimed.

21 Claims, 11 Drawing Sheets

LIGHT DEVICE AND SUPPORT DEVICE

TECHNICAL FIELD

The present disclosure relates generally to the field of lighting devices.

BACKGROUND

Flashlights and other task lights are often used to illuminate an area while performing work, such as electrical work, utility work, automotive work, etc. With many lighting systems it can be difficult to position the light to properly illuminate the work area.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION

Figure 1:
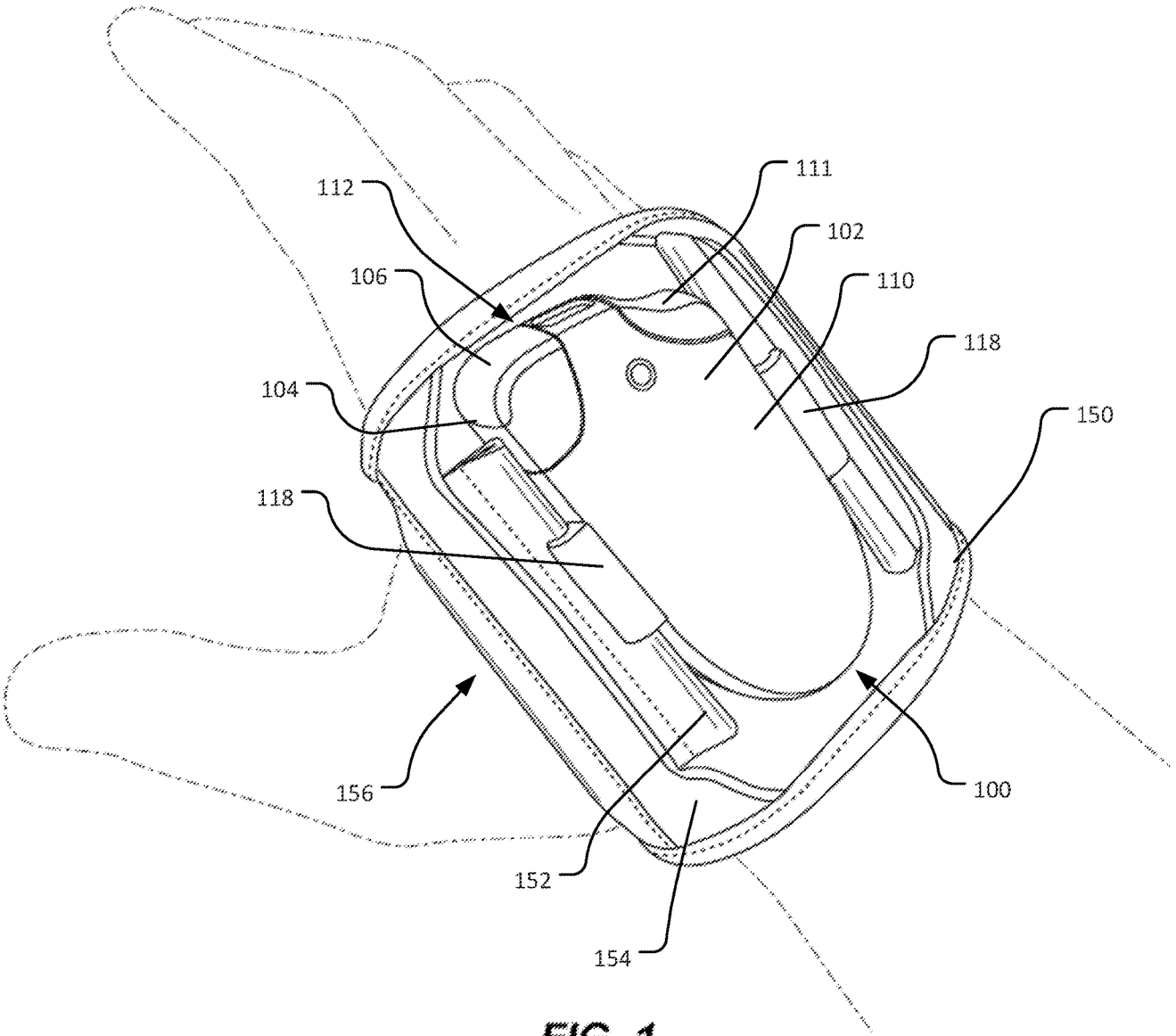
FIG. 1 illustrates a light device coupled to a glove wrap that is wrapped around a hand of a user, with a light unit of the light device in a retracted position, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Various embodiments herein provide a light device that is selectively attachable to a support device. For example, in some embodiments, the light device may be selectively attachable to a support device that may be worn on a hand of a user (e.g., a glove, fingerless glove, glove wrap, etc.). The light device may include a housing and a light unit coupled to the housing. The light unit may be selectively extendable from the housing, e.g., via a flexible neck.

The light device may include an engagement mechanism to selectively couple the light device to the support device in any of multiple configurations (e.g., with the light unit facing in a first direction or a second direction (opposite the first direction), and/or with one side of the light device facing toward or away from a surface of the support device). For example, in some embodiments, the light unit may include a pair of C-shaped members that slidably couple to respective rails on the support device (e.g., from either end of the rails. The engagement mechanism may additionally or alternatively include other means for selectively attaching the light unit to the other device, such as one or more magnets, hook-and-loop fasteners, clips, etc.

The light device is described herein with reference to being selectively attachable to a glove wrap. However, it will be apparent that the light device may be attachable to other suitable support devices. For example, the support device may be a wearable device, such as wearable on a hand of a user (e.g., a glove with fingers, a fingerless glove, a glove wrap), a head of a user (also referred to as headwear, such as a helmet and/or hat), and/or on a body of a user (e.g., a vest, such as a safety vest, or another garment such as a belt, pants, etc.). Additionally, or alternatively, the support device may another suitable device, such as a portion of a workspace (e.g., electrical box, a portion of a car, etc.).

In some embodiments, the engagement mechanism of the support device (e.g., rails) may be selectively attachable to the body of the support device, e.g., via a hook-and-loop fastener, an adhesive, another type of mechanical coupling mechanism, one or more magnets, etc. For example, the engagement mechanism may be disposed on a patch that is selectively attachable to the body of the support device. The engagement mechanism may or may not be readily detachable after it is selectively attached to the support device.

Figure 2:
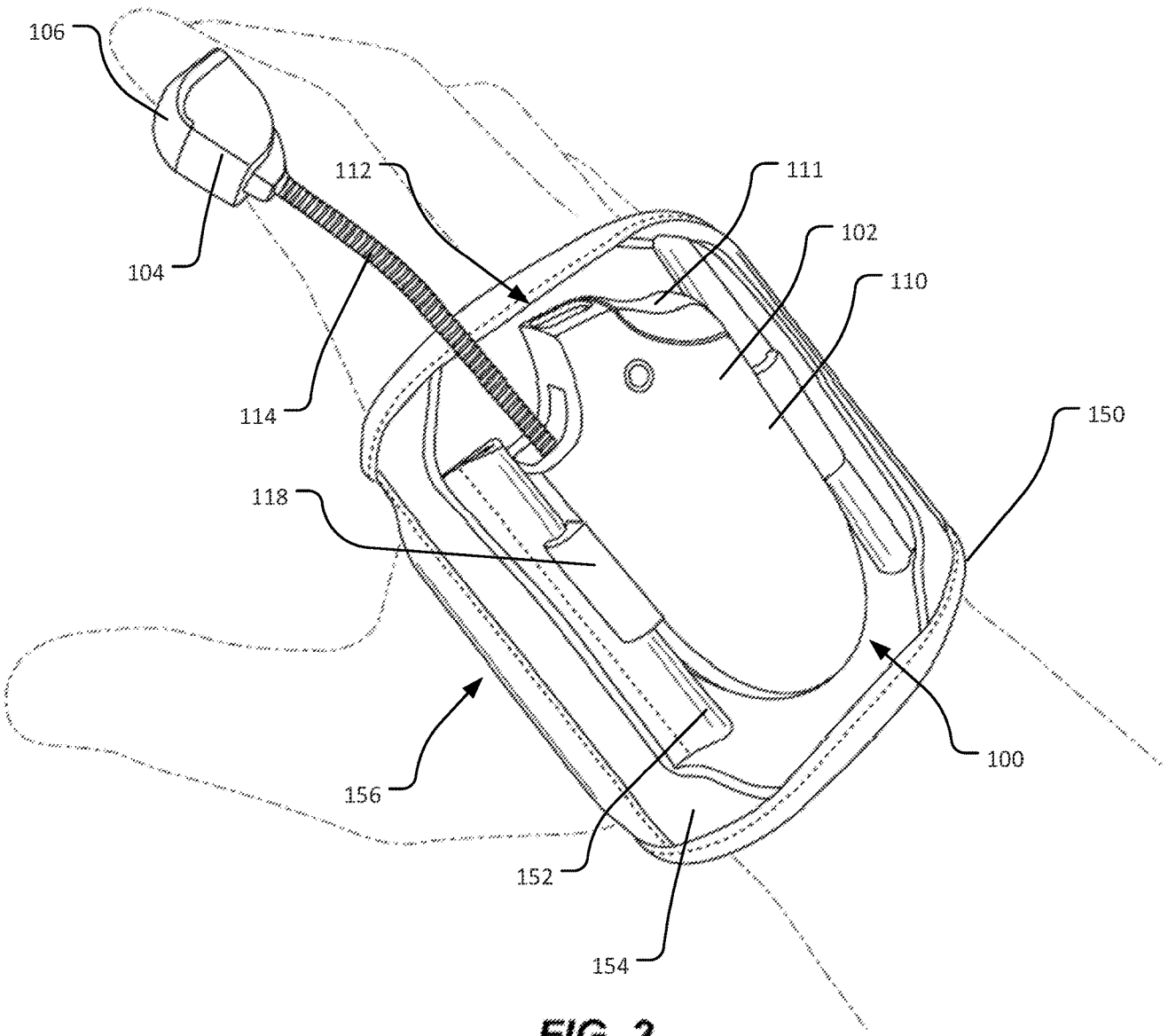
FIG. 2 illustrates the light device coupled to the glove wrap that is wrapped around the hand, with the light unit of the light device in an extended position, in accordance with various embodiments.
Figure 7:
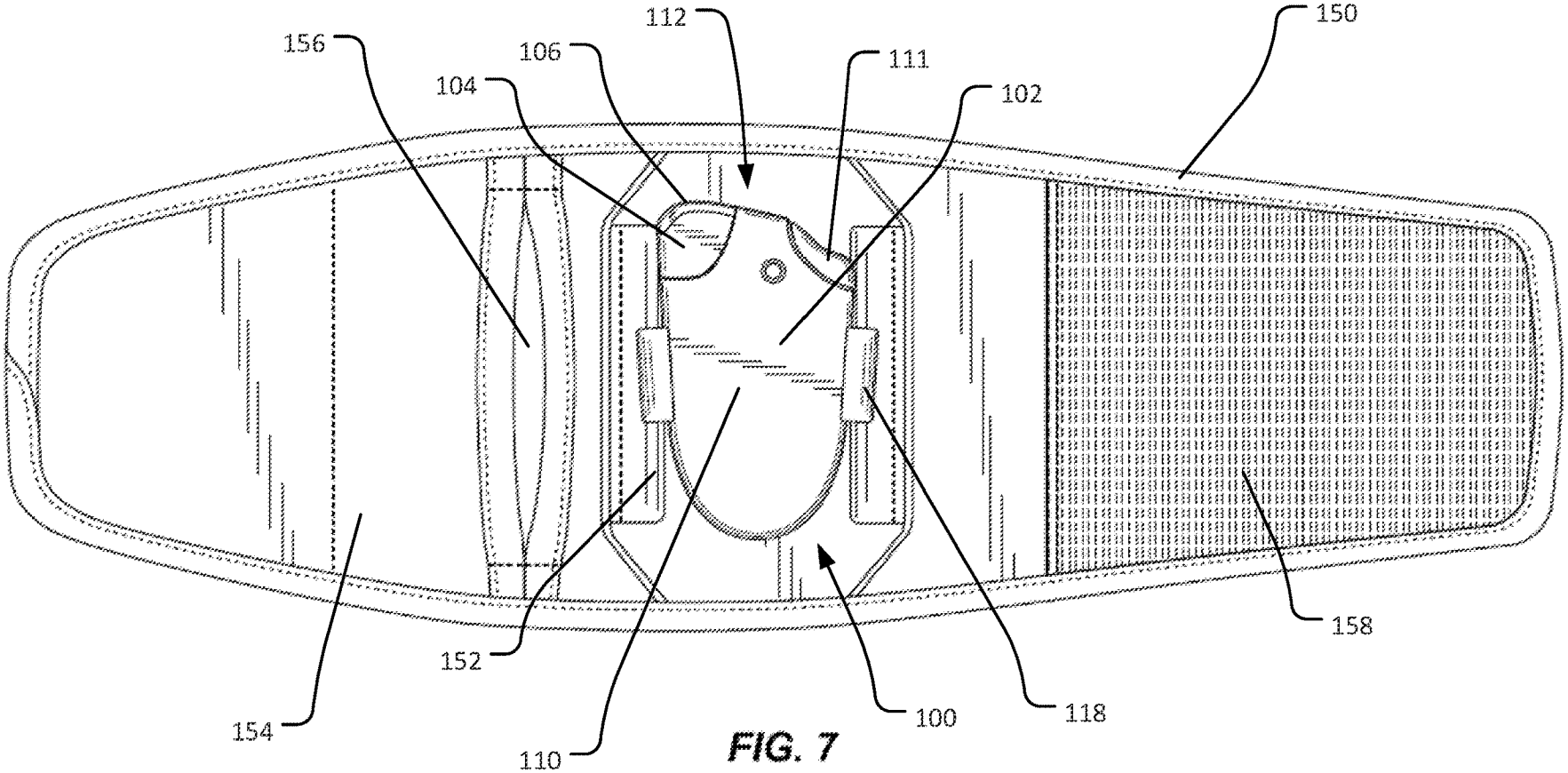
FIG. 7 illustrates the light device coupled to the glove wrap with the glove wrap unwrapped, in accordance with various embodiments.
Figure 8:
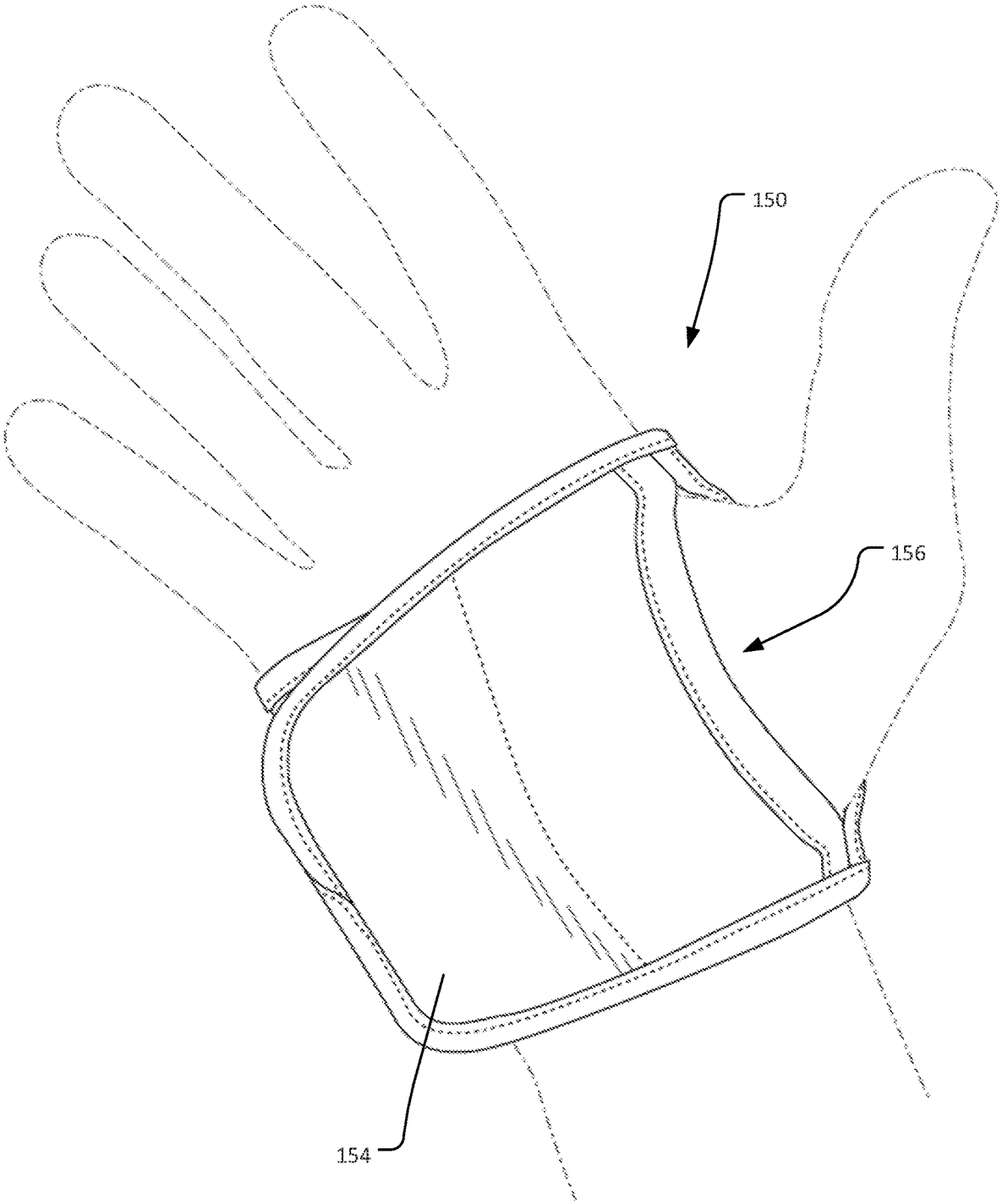
FIG. 8 is a bottom view of the glove wrap wrapped on a hand, in accordance with various embodiments.

FIGS. 3-6 and 9 illustrate a light device 100 in accordance with various embodiments. FIGS. 1, 2, and 7 illustrate the light device coupled to a glove wrap 150. FIG. 8 illustrates a bottom view of the glove wrap 150 wrapped around a hand.

The light device 100 includes a housing 102 and a light unit 104. The light unit 104 may include one or more lighting elements 106, such as light emitting diodes (LEDs) and/or other suitable lighting elements. The light device 100 may include a power interface within the housing 102 to receive power source, such as a rechargeable battery and/or single use battery. In some embodiments, the housing 102 of the light device 100 may include a first side 108 and a second side 110 opposite the first side 108. As shown, the housing 102 may have a relatively flat shape with the first side 108 and second side 110 being significantly larger than other sides/surfaces of the housing 102. It will be apparent that other shapes of the housing 102 may be used in accordance with various embodiments herein.

In some embodiments, the light unit 104 may be located on a front side 112 of the light device 100. For example, the light unit 104 may be located offset from the center of the front side 112, e.g., at a corner of the light device 100 and/or housing 102. As discussed further herein, the light device 100 may be coupled to a support device (e.g., glove wrap 150) in a variety of configurations. The laterally offset location of the light unit 104 may enable the orientation of the one or more lighting elements 106 to be adjusted based on the needs of the user. The light device 100 may include one or more controls 111 (e.g., one or more buttons) to control operation of the light (e.g., to turn the light on and off and/or adjust a lighting mode of the light (e.g., color, intensity, etc.)). The one or more controls 111 may be located on the opposite end of the front side 112 from the light unit 104, as shown, and/or in another location.

Figure 3:
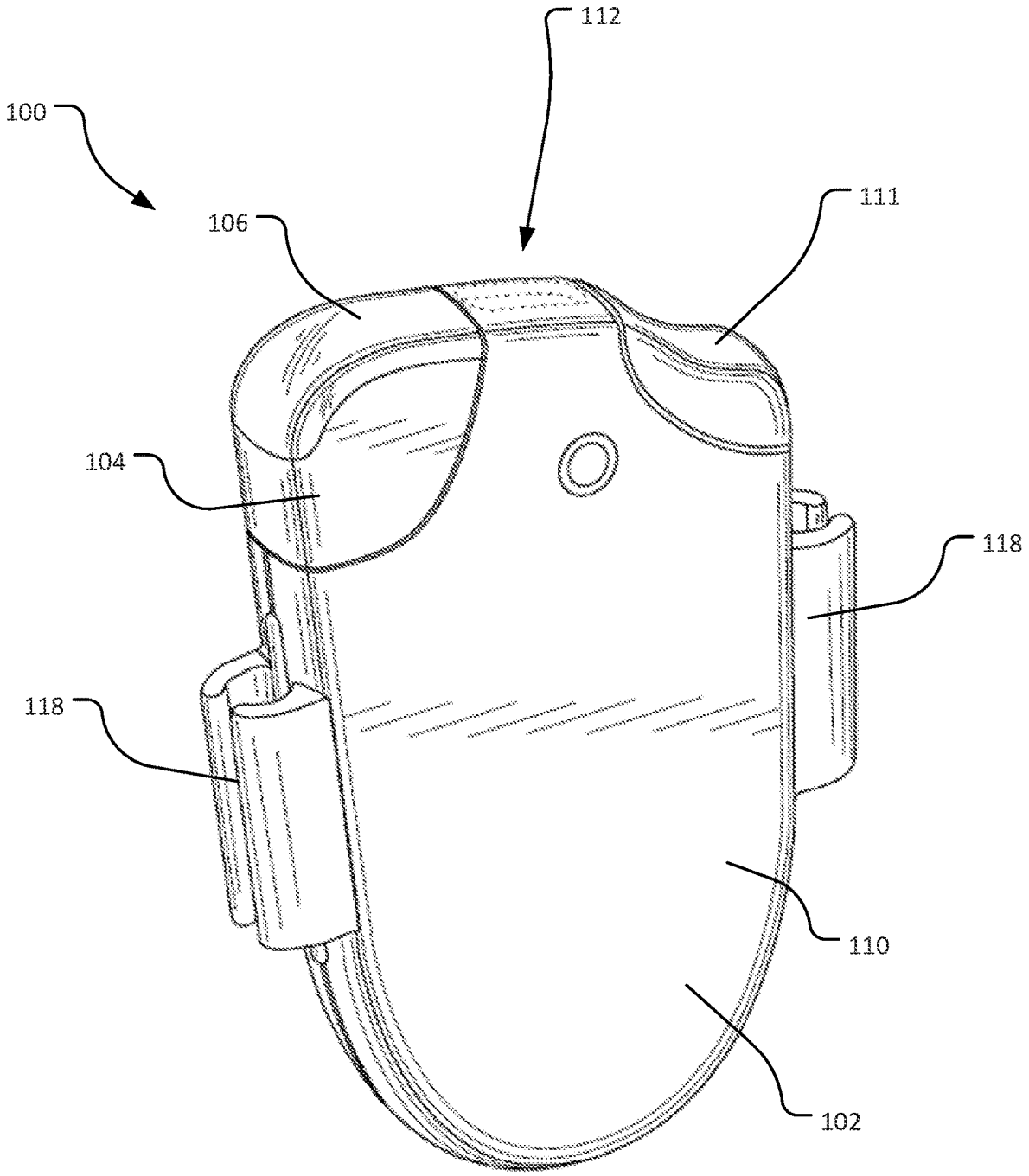
FIG. 3 is a perspective view of the light device, in accordance with various embodiments.
Figure 4:
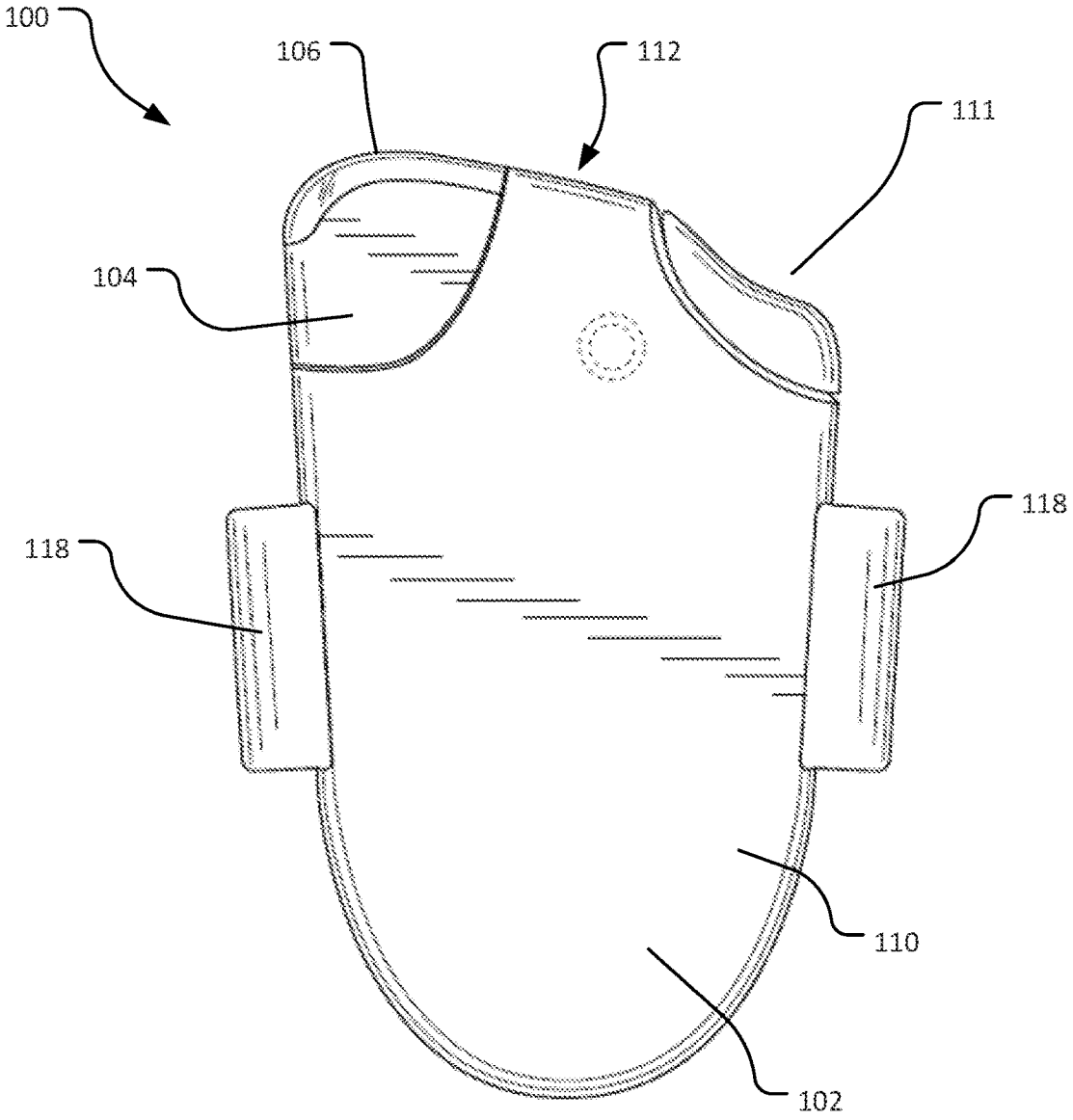
FIG. 4 is a top view of the light device, in accordance with various embodiments.
Figure 5:
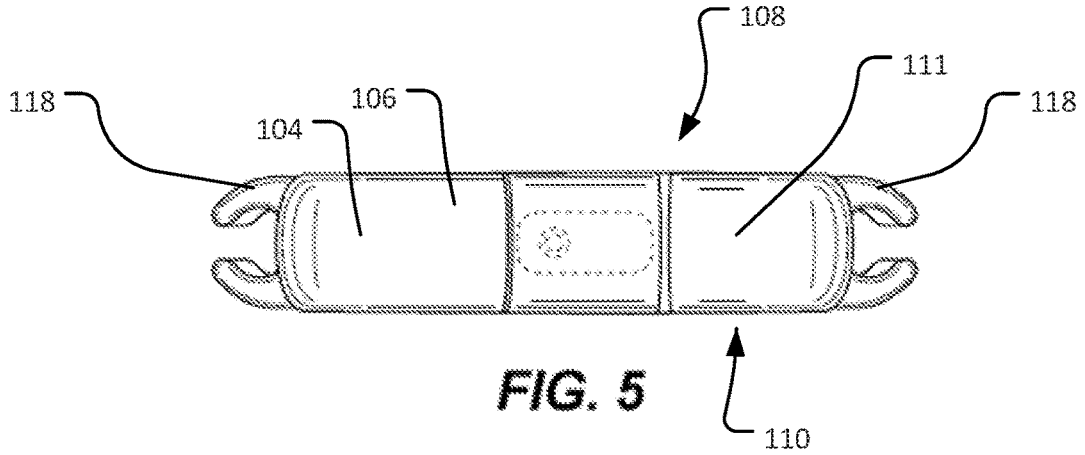
FIG. 5 is a front view of the light device, in accordance with various embodiments.

In various embodiments, the light unit 104 may be selectively extendable from the housing 102. FIGS. 3-5 illustrate the light device 100 with the light unit 104 in a retracted position. As shown, the light unit 104 may be adjacent the housing 102 in the retracted position. For example, the surfaces of the light unit 104 may abut (e.g., be substantially co-planar with) the surfaces of the housing 102 (e.g., first side 108, front side 110, first side 112).

Figure 6:
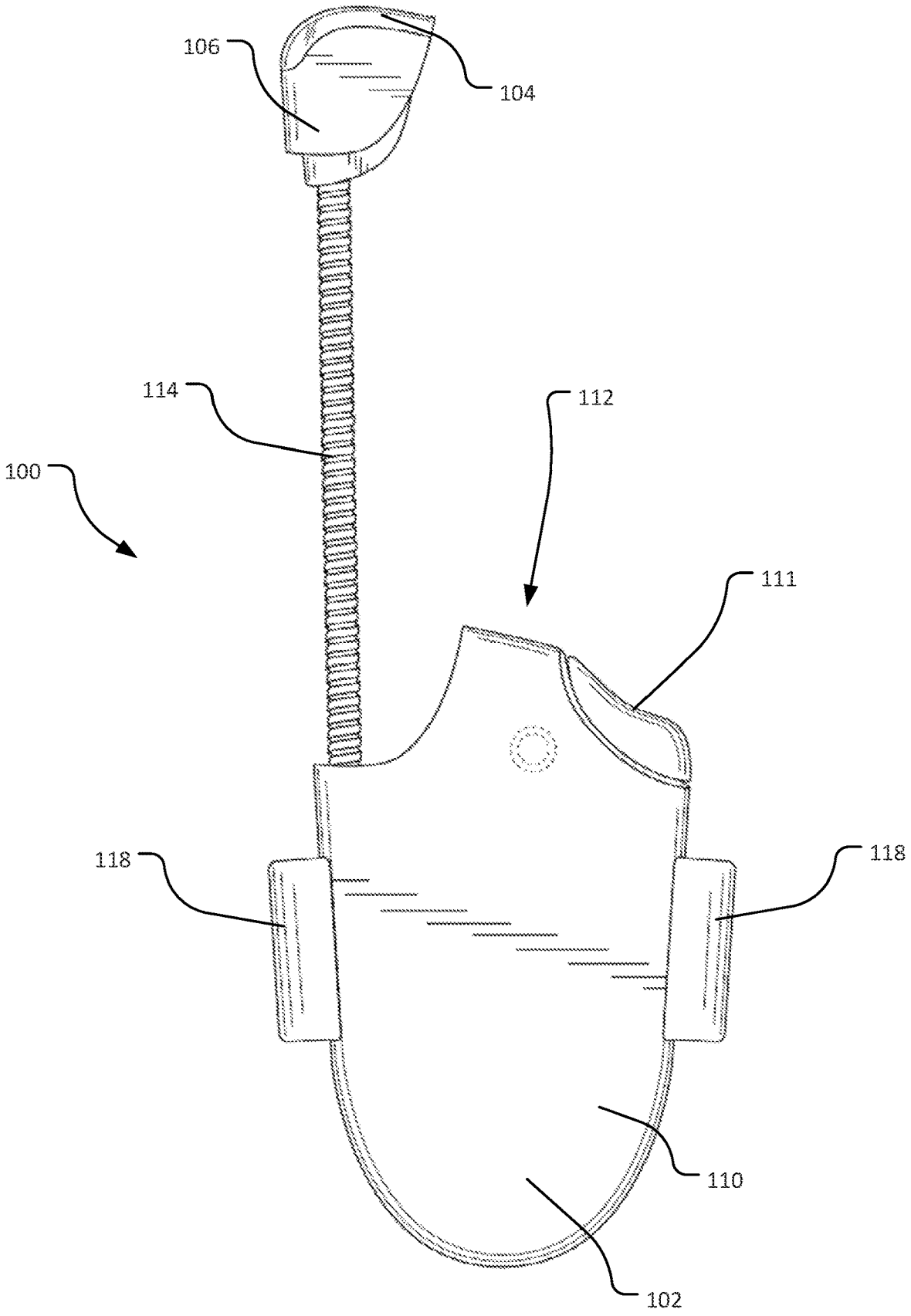
FIG. 6 is a top view of the light device with the light unit of the light device in the extended position, in accordance with various embodiments.
Figure 9:
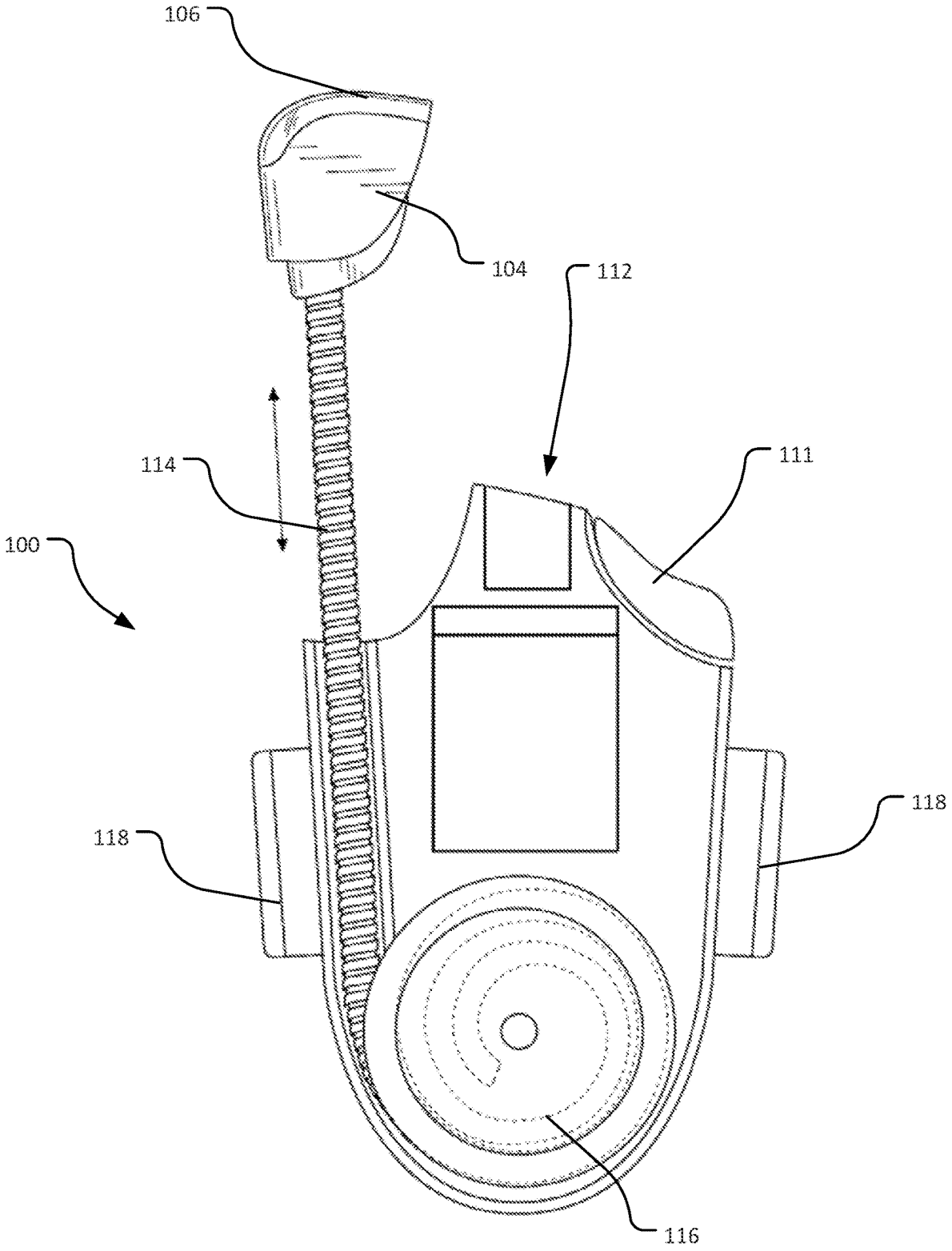
FIG. 9 is a top view of the light device with a top housing removed to show internal structure, including a spool for a retractable neck, in accordance with various embodiments.

FIG. 6 illustrates the light device 100 with the light unit 104 in an extended position. The light unit 104 may be coupled to a neck 114 that extends from the housing 102. The neck 114 may be flexible to enable the light unit 104 to be directed in many different directions. The flexible neck 114 may be bendable by the user but may generally stay in a given location when force is not applied to the neck 114. As shown in FIG. 9, the light device 100 may further include a spool 116 within the housing 102 and coupled to the neck 114 to enable the selective extension of the light unit 104 to the extended position and retraction of the light unit 104 back to the retracted position. In some embodiments, the extension and/or retraction may be passive e.g., require the user to apply force to the light unit 104 and/or neck 114 to extend and/or retract the light unit 104. For example, the user may push and/or pull the light unit 104 and/or neck 114. Additionally, or alternatively, the spool may include a handle to enable the user to rotate the spool to extend and/or retract the light unit 104. In other embodiments, the light device 100 may include an active retraction mechanism to extend and/or retract the light unit 104. The active retraction mechanism may be mechanical (e.g., a biasing mechanism such as a spring-loaded spool), magnetic, and/or electronic. In some embodiments, the retraction mechanism may include a control (e.g., button) to cause the light unit 104 to retract and/or extend. Alternatively, the light unit 104 may be retracted without a control, e.g., by pulling and releasing the light unit 104 and/or flexible neck 114.

The light device 100 may include an engagement mechanism 118 to couple the light device 104 to a support device. For example, FIGS. 1 and 2 illustrate the light device 100 coupled to a glove wrap 150. The glove wrap 150 may include an engagement mechanism 152 that engages with the engagement mechanism 118 of the light device 100 to couple the light device 100 to the glove wrap 150. In some embodiments, as shown, the engagement mechanism 152 may include a pair of rails and the engagement mechanism 118 of the light device 100 may include a pair of C-shaped members that engage with the rails. For example, the C-shaped members may slide onto the rails to couple the light device 100 to the glove wrap 150. Other types of engagement mechanisms 118 and 152 may be used in addition to or instead of the engagement mechanisms 118 and 152 depicted in the figures. For example, the engagement mechanisms 118 and 152 may include another type of mechanical engagement mechanism (e.g., a hook-and-loop fastener and/or clip) and/or a magnetic engagement mechanism.

The engagement mechanisms 118 and 152 may enable the light device 100 to be coupled to the glove wrap 150 in multiple configurations. For example, in a first configuration, the first side 108 faces the glove wrap 150 and the second side 110 faces away from the glove wrap 150. In a second configuration, the first side 108 faces away from the glove wrap 150 and the second side 110 faces the glove wrap 150. This places the light unit 104 on the other side of the light device 100 with reference to the user of the glove wrap 150. In both the first and second configurations, the front side 112 of the light device may face in a first direction (e.g., toward the fingers of the user). In some embodiments, the engagement mechanisms 118 and 152 may enable the light device 100 to further be coupled to the glove wrap 150 with the front side 112 facing in a second direction opposite the first direction. For example, the light device 100 may be coupled in a third configuration in which the front side 112 faces the second direction, the first side 108 faces the glove wrap 150, and the second side 110 faces away from the glove wrap 150. The light device 100 may further be coupled in a fourth configuration in which the front side 112 faces the second direction, the first side 108 faces away from the glove wrap 150, and the second side 110 faces the glove wrap 150.

As shown in FIGS. 1, 2, 7, and 8, the glove wrap 150 may include a body 154 with an opening 156 through which the thumb of the user's hand may be inserted when wearing the glove wrap. The glove wrap 150 may further include a fastener 158 (e.g., hook-and-loop fastener) to secure the glove wrap 150 around the user's hand. The engagement mechanism 152 may be coupled to the body 154 of the glove wrap 150. For example, as shown, the engagement mechanism 152 may include a pair of rails (e.g., rods disposed within a sheath of fabric or another suitable material). In some embodiments, the engagement mechanism 152 may be selectively attachable to the body 154 of the glove wrap 150. For example, the engagement mechanism 152 (e.g., rails) may be disposed on a patch that is selectively attachable to the body 154 of the glove wrap 150, e.g., via a hook-and-loop fastener, another type of mechanical coupling mechanism, one or more magnets, etc. The same or similar configuration may be used to selective attach an engagement mechanism to another type of support device, such as headwear (e.g., a hat or helmet), a garment (e.g., safety vest), a portion of a workspace, etc.

Figure 10:
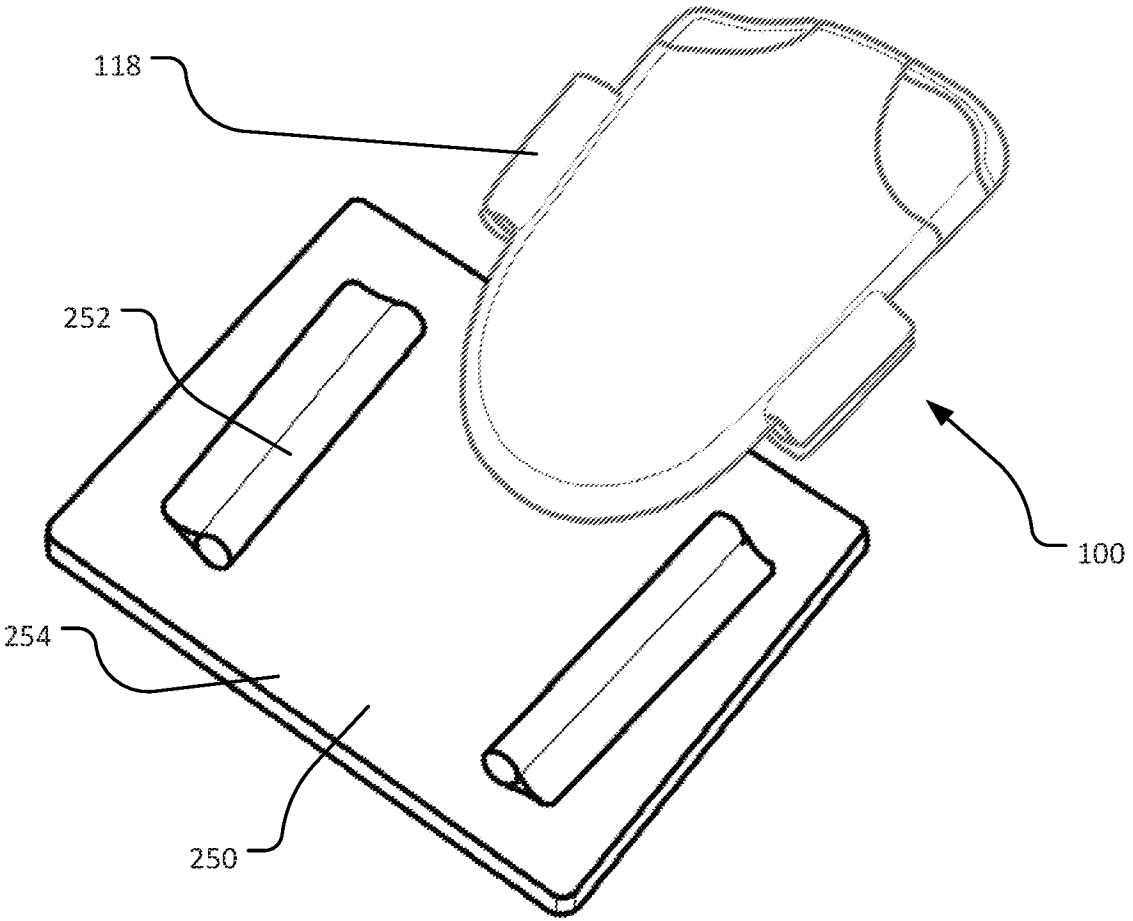
FIG. 10 illustrates a patch with an engagement mechanism to selectively couple with a light unit, in accordance with various embodiments. The patch may be selectively attached to another surface.
Figure 11:
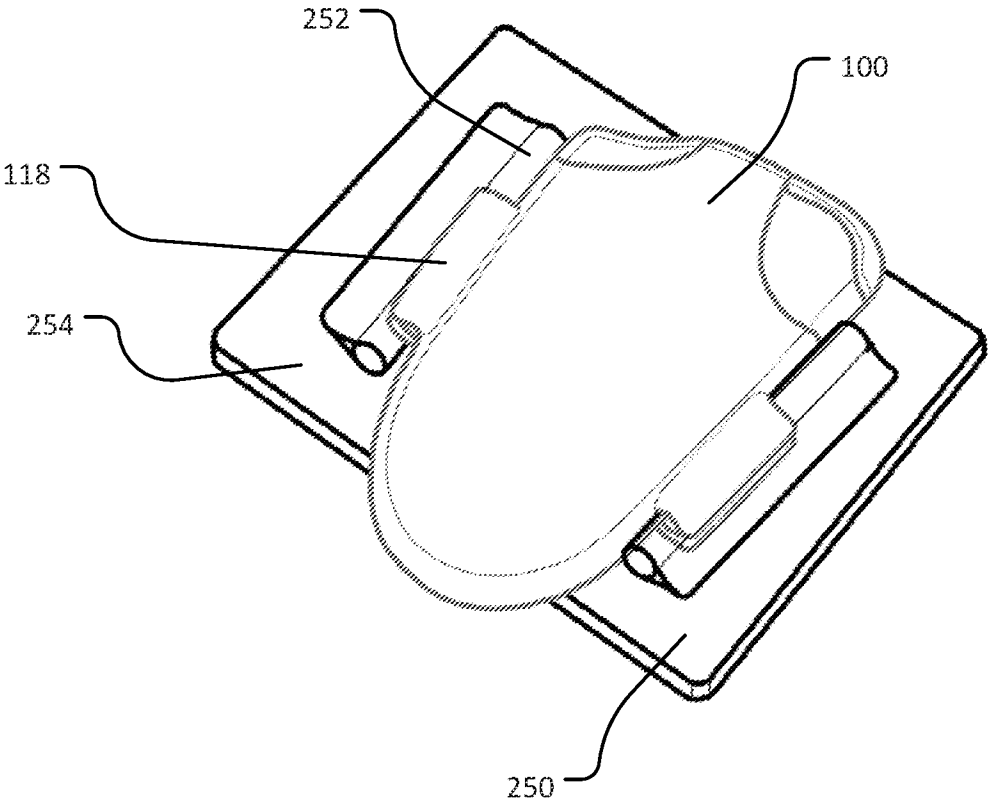
FIG. 11 illustrates the patch of FIG. 10 with the light unit attached, in accordance with various embodiments.

For example, FIG. 10 illustrates a patch 250 with an engagement mechanism 252 (e.g., rails) coupled to a body 254 of the patch 250. The light device 100 may be selectively attached to the patch 250, via the engagement mechanism 252 of the patch 250 and the engagement mechanism 118 of the light device 100 as shown in FIG. 11. The patch 250 may be selectively attachable to another surface (e.g., via hook-and-loop fastener, an adhesive, another type of mechanical coupling mechanism, one or more magnets, etc.). For example, the patch 250 may be selectively attached to the glove wrap 150 and/or another support device as discussed herein. The body 254 of the patch 250 may be made of any suitable material, such as a flexible or rigid material, e.g., fabric, plastic, rubber, metal, etc.

Figure 12:
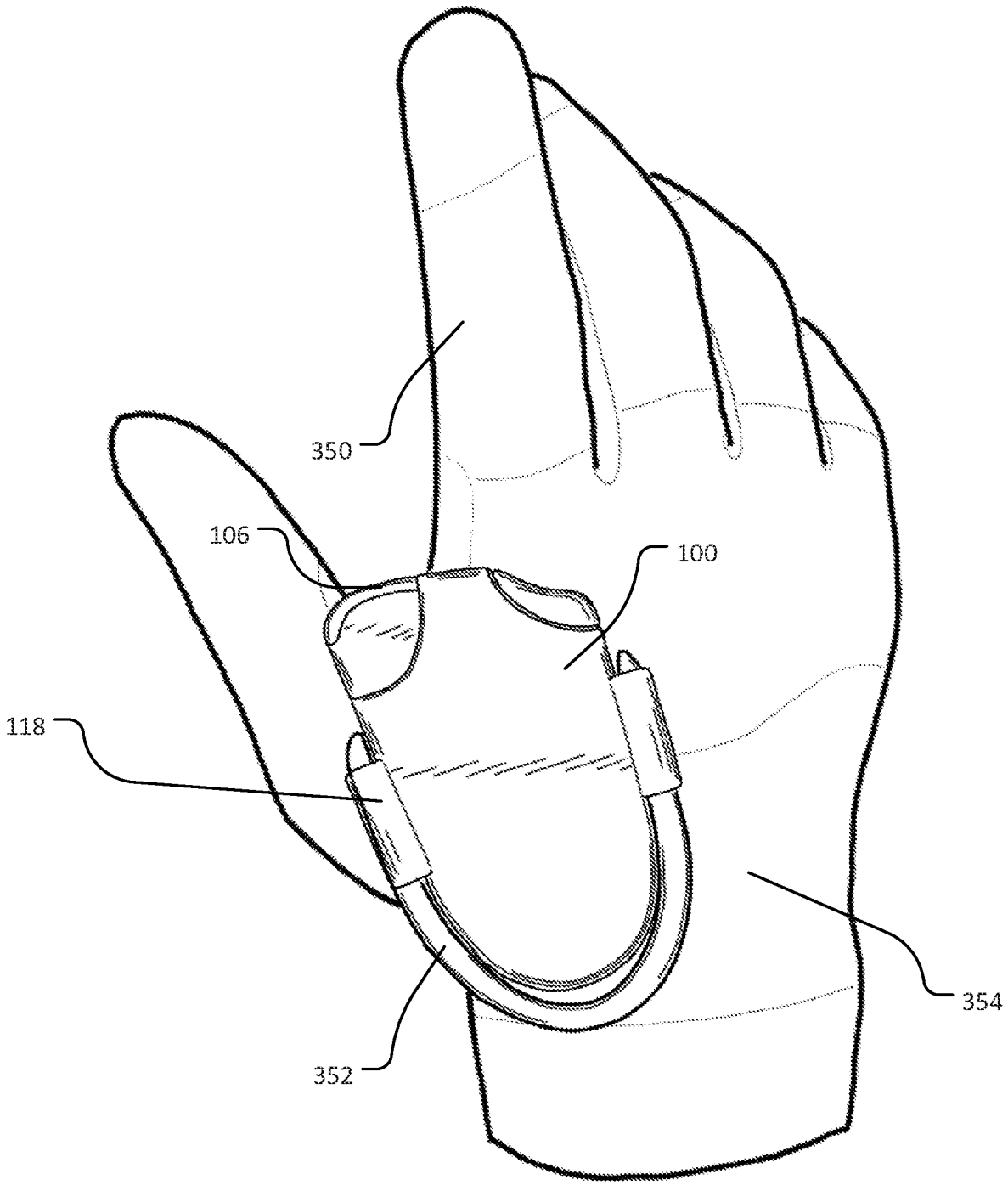
FIG. 12 illustrates the light device coupled to a glove, in accordance with various embodiments.

As shown in FIGS. 1, 2, and 8, the glove wrap 150 may not cover the user's fingers, thus enabling the user's fingers to be unencumbered while wearing the glove wrap 150. In other embodiments, the glove wrap 150 may cover all or part of the user's fingers (e.g., in a glove or fingerless glove configuration). For example, FIG. 12 illustrates the light device 100 selectively coupled to a glove 350. The glove 350 includes an engagement mechanism 352 on a body 354 of the glove 350. As shown, the engagement mechanism 352 has a U-shape with a pair of rails connected on one end, in contrast to the separate rails of engagement mechanism 152 and/or 252 as depicted in the figures. The U-shape may enable the light device 100 to be attached with the light 106 directed forward (toward the fingers) and with the light 106 on either the left side or right side of the front face. However, the U-shape of the engagement mechanism 352 may not enable the light device 100 to be attached with the light 106 directed backward (away from the fingers). Other configurations of the engagement mechanism 352 may be used in accordance with various embodiments.

In various embodiments, the glove wrap and engagement mechanism 152 may position the light device 100 on or near a base of the hand of the user, e.g., on the wrist of the user and/or on a base of the hand below the base of the thumb. This region may not move as much as other regions of the hand when the hand and/or fingers are moving, thus providing more stability for the light emitted by the light device 100.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A lighting system comprising:

a support device to be worn on a hand and/or a wrist of a user; and a light device to be removably coupled to the support device, wherein the light device includes a housing and a light unit that is extendable from the housing;

wherein the light device and the support device include respective engagement mechanisms that enable the light device to be coupled to the glove wrap in either of:

a first configuration in which a first side of the light device faces the glove wrap and a second side of the light device faces away from the support device; and a second configuration in which the first side of the light device faces away from the glove wrap and the second side of the light device faces the support device.

2. The lighting system of claim 1, wherein the light device further includes a flexible neck coupled to the light unit to enable the light unit to be extended from the housing and oriented in different directions.

3. The lighting system of claim 1, wherein the light device further includes a retraction mechanism to selectively retract the light unit to a retracted position in which the light unit is adjacent the housing.

4. The lighting system of claim 1, wherein the support device includes a pair of rails that engage with the light device to couple the light device to the glove wrap.

5. The lighting system of claim 1, wherein the light unit is on a front side of the light device, wherein the front side is pointed in a first direction toward fingers of the user when the light device is coupled in the first configuration and the second configuration, and wherein the engagement mechanisms further enable the light device to be coupled to the support device in a third configuration in which the front side of the light device is pointed in a second direction opposite the first direction.

6. The lighting system of claim 1, wherein the light device is to be coupled to the support device such that the light device is positioned on the wrist of the user or a base of the hand below a base of the thumb.

7. The lighting system of claim 1, wherein the support device is a glove wrap configured to be worn on the left hand and the right hand of the user.

8. A light device comprising:

a housing;

an engagement mechanism coupled to the housing to couple the light device to another device, wherein the engagement mechanism includes a pair of C-shaped members to slidably engage with respective rails of the another device; and a light unit coupled to the housing via an extendable and flexible neck, wherein the neck is to selectively extend the light unit from the housing.

9. The light device of claim 8, further comprising a retraction mechanism to selectively retract the light unit to a retracted position in which the light unit is adjacent the housing.

10. The light device of claim 8, wherein the light unit is extendable from a front side of the housing and is offset toward one lateral edge of the front side.

11. The light device of claim 10, wherein the engagement mechanism is to couple the light device to the other device in either of:

a first configuration in which a first side of the light device faces a first direction and a second side of the light device faces a second direction that is opposite the first direction; and a second configuration in which the first side of the light device faces the second direction and the second side of the light device faces the first direction.

12. The light device of claim 11, wherein the front side faces a third direction when the light device is in the first configuration and the second configuration, and wherein the engagement mechanism is further to couple the light device to the other device in a third configuration in which the front side of the light device is pointed in a fourth direction opposite the third direction.

13. A lighting system comprising:

a support device that includes a pair of rails; and a light device that includes:

a housing;

a pair of C-shaped members to slidably engage with respective rails of the pair of rails to couple the light device to the support device;

a light unit; and a flexible neck coupled to the light unit, wherein the light unit is switchable between a retracted position in which the light unit is adjacent the housing and an extended position in which the light unit is extended away from the housing via the flexible neck.

14. The lighting system of claim 13, wherein the light device further includes a retraction mechanism to selectively retract the light unit to the retracted position.

15. The lighting system of claim 13, wherein the rails and the C-shaped members enable the light device to be coupled to the support device in either of: a first configuration in which a first side of the light device faces a surface of the support device and a second side of the light device faces away from the surface; and a second configuration in which the first side of the light device faces away from the surface and the second side of the light device faces the surface.

16. The lighting system of claim 15, wherein the light unit is on a front side of the light device, wherein the front side is pointed in a first direction when the light device is coupled in the first configuration and the second configuration, and wherein the rails and the C-shaped members further enable the light device to be coupled to the support device in a third configuration in which the front side of the light device is pointed in a second direction opposite the first direction.

17. The lighting system of claim 13, wherein the support device is to be worn on a hand or body of a user.

18. The lighting system of claim 13, wherein the pair of rails are selectively attachable to a body of the support device.

19. A light device comprising:

a housing;

an engagement mechanism coupled to the housing to couple the light device to another device; and a light unit coupled to the housing via an extendable and flexible neck, wherein the neck is to selectively extend the light unit from the housing;

wherein the engagement mechanism is to couple the light device to the other device in either of:

a first configuration in which a first side of the light device faces a first direction and a second side of the light device faces a second direction that is opposite the first direction; and a second configuration in which the first side of the light device faces the second direction and the second side of the light device faces the first direction.

20. The light device of claim 19, wherein the light unit is extendable from a front side of the housing and is offset toward one lateral edge of the front side.

21. The light device of claim 19, wherein the front side faces a third direction when the light device is in the first configuration and the second configuration, and wherein the engagement mechanism is further to couple the light device to the other device in a third configuration in which the front side of the light device is pointed in a fourth direction opposite the third direction.

* * * * *